US005249021A

United States Patent [19]

Hasegawa et al.

[11] Patent Number: 5,249,021

[45] Date of Patent: Sep. 28, 1993

[54] IMAGE FORMING APPARATUS HAVING RECORDING MATERIAL CARRYING MEANS

[75] Inventors: Takashi Hasegawa, Ageo; Koji Amemiya, Tokyo, both of Japan

[73] Assignee: Canon Kabushiki Kaisha, Tokyo, Japan

[21] Appl. No.: 841,520

[22] Filed: Feb. 26, 1992

[30] Foreign Application Priority Data

Feb. 28, 1991 [JP] Japan ..... 3-058018

[51] Int. Cl.[5] ..... G03G 15/14

[52] U.S. Cl. ..... 355/271; 355/272; 355/273; 355/277; 355/326; 355/327

[58] Field of Search ..... 355/271-275, 355/277, 326, 327

[56] References Cited

U.S. PATENT DOCUMENTS 4,862,214 8/1989 Kasahara et al. ..... 355/277

FOREIGN PATENT DOCUMENTS 0336366 10/1989 European Pat. Off. ..... 355/326
0372952 6/1990 European Pat. Off. ..... 355/274
0386978 9/1990 European Pat. Off. ..... 355/275
0400996 12/1990 European Pat. Off. ..... 355/274
0401977 12/1990 European Pat. Off. ..... 355/274
0415676 3/1991 European Pat. Off. ..... 355/326
0415741 3/1991 European Pat. Off. ..... 355/326
0107256 8/1981 Japan ..... 355/271
0099170 5/1986 Japan ..... 355/271
0004270 1/1991 Japan ..... 355/274
0004272 1/1991 Japan ..... 355/274
0004273 1/1991 Japan ..... 355/274

*Primary Examiner*—A. T. Grimley
*Assistant Examiner*—Matthew S. Smith
*Attorney, Agent, or Firm*—Fitzpatrick, Cella, Harper & Scinto

[57] ABSTRACT

An image forming apparatus includes an image forming device for forming images on a recording material at an image forming position, and a movable recording material carrying device for carrying and conveying the recording material to the image forming position. The recording material carrying device has a carrying sheet for carrying the recording material, and a frame for supporting the carrying sheet. The distance between a portion of the carrying sheet which is fixed to the frame and an end portion of the recording material of the maximum size carried on the carrying sheet is 20 mm or more in a direction substantially perpendicular to the direction in which the recording material carrying device is moved.

13 Claims, 9 Drawing Sheets

IMAGE FORMING APPARATUS HAVING RECORDING MATERIAL CARRYING MEANS

BACKGROUND OF THE INVENTION

1. Field of the Invention

The present invention relates to an image forming apparatus for forming an image on a recording material carried on recording material carrying means, such as a transfer drum. Particularly, the present invention pertains to an image forming apparatus for transferring a visible image formed on an image carrying member onto a recording material carried on the recording material carrying means.

2. Description of the Related Art {In a conventional image forming apparatus which employs the electrophotographic process, a toner image formed on an image carrying member, such as a photosensitive drum, is transferred onto a sheet-like transfer material, such as a sheet of paper, by means of a transfer device.

Particularly, in the full-color electrophotographic apparatus, a transfer drum such as that shown in FIGS. 9 and 10 is used as the transfer device for transferring a plurality of toner images on the same transfer material in such a manner that the subsequent toner image is placed on top of the previous one. This transfer drum includes a retaining frame formed by coupling two ring members 5*a* by a coupling member 5*c*, as shown in FIG. 9, and a transfer material carrying member which is a recording material carrying sheet, i.e., a flexible transfer material carrying sheet 52, whose four sides, i.e., the hatched portion, are adhered to and thereby wound around the retaining frame, as shown in FIG. 10. A transfer material P is electrostatically attached to the transfer material carrying sheet 52.

However, the aforementioned type of transfer drum which electrostatically attaches the transfer material P has drawbacks in that (1) it requires a corona charger or a charging brush as charge application means and is therefore expensive and (2) attachment of the transfer material P is instable depending on the temperature or humidity of the atmosphere. Hence, a transfer drum shown in FIG. 11 has been proposed. This transfer drum has grippers 51 for mechanically gripping the forward end of the transfer material P so as to allow the transfer material P to be reliably gripped and conveyed.

FIG. 12 illustrates the dimensional relationship between the transfer material carrying sheet 52 and the transfer material P in the aforementioned types of conventional transfer drums. As shown in FIG. 12, the transfer drum has a size which ensures that the transfer material P having the maximum size A3 can be held in a longitudinally fed state (in a state where the longitudinal direction of the transfer material is substantially identical with the direction in which the transfer drum is moved). Furthermore, the image transferred onto the transfer material is set such that transfer of that image leaves a blank frame (a non-image-forming area with respect to image data), shown in FIG. 12, on the sheet of paper which is the transfer material.

The function of the transfer drum will be explained below with reference to FIG. 13 which illustrates the fullcolor electrophotographic copying machine.

In the copying machine shown in FIG. 13, around a photosensitive drum 1 are disposed a corona charger 2, an exposure optical system 3, a developing device 4, a transfer drum 5, and a cleaner 6. The optical system 3 includes an original scanning portion 3*a* and a color decomposing filter 3*b*. The developing device 4 has developers of four colors, that is, a yellow developer 4Y, magenta developer 4M, a cyan developer 4C and a black developer 4K. These four developers are mounted on a housing 4*a* which can be rotated about a central axis 4*b* so as to allow development of the four colors to be conducted in sequence.

The transfer drum 5 has ring members 5*a*, a transfer charger 5*b*, transfer material grippers 51, an inner charger 5*d*, and an outer charger 5*e*. As shown in FIG. 10, a transfer material carrying sheet 52 extends over an open area formed by the ring members 5*a* and the coupling member 5*c*, which serve as the frame. The transfer material P is supported and conveyed by this transfer material carrying sheet 52.

To form a full-color image in the copying machine shown in FIG. 13, a green-color-decomposed electrostatic latent image is first formed on the photosensitive drum 1, and the formed latent image is developed by the magenta developer 4M. In the meantime, the transfer material P fed from a transfer material cassette 7 to the transfer drum 5, by means of a conveying system, is gripped by the grippers 51 of the transfer drum 5. As the rotation of the transfer drum 5 proceeds, the toner image on the photosensitive drum 1 is transferred onto the transfer material P by means of the transfer charger 5*b*. Concurrently with this, the transfer material P is attached to the transfer material carrying sheet 52.

A similar process is repeated for the cyan, 4C, yellow, 4Y, and black 4K, developers to transfer toner images of the four colors. Thereafter, the transfer material P is separated from the transfer drum 5, and the toner on the transfer material is melted and mixed with each other by means of a heat roller fixer 9. The fixed transfer material P is discharged to a tray 10.

However, in the aforementioned conventional transfer device, when the photosensitive drum 1 and the transfer material carrying sheet 52 are located closest to each other, toner particles or dust floating in the image forming apparatus stays at an end area A of the transfer material carrying sheet 52 as shown in FIG. 14(A), in the direction substantially perpendicular to the direction in which the transfer drum is moved. Such toner particles or dust will damage and twist the end portion of the transfer material carrying sheet 52, as shown in FIG. 14 (B) when the copying machine is continuously used. This damage or twisting occurs because the rear surface of the area A is adhered to the ring member 5*a*, as shown in FIG. 14(A), and the pressure of the photosensitive drum 1 increases in that area, causing the toner particles and dust to be readily fixed to the area A of the transfer material carrying sheet 52.

When the copying machine is operated in the above-described state, adhesion of the toner image located on the photosensitive drum 1, to the transfer material P on the transfer material carrying sheet 52, greatly deteriorates, thus forming a low quality image having a transfer failure at the end portions of the transfer material P, as shown in FIG. 15.

SUMMARY OF THE INVENTION

A primary object of the present invention is to provide an image forming apparatus which is capable of preventing the occurrence of image failure at the end portions of a recording material, so as to enable high quality images to be formed.

Another object of the present invention is to provide an image forming apparatus which ensures excellent adhesion between the end portion of a recording material and an image carrying member.

Still another object of the present invention is to provide an image forming apparatus which enables images to be formed with no transfer failure, even when the image forming apparatus is used for a long period of time.

To achieve the aforementioned objects, the present invention provides an image forming apparatus which comprises image forming means for forming images on a recording material at an image forming position, and movable recording material carrying means for carrying and conveying the recording material to the image forming position. The recording material carrying means includes a carrying sheet for carrying the recording material, and a frame for supporting the carrying sheet. The distance between a portion of the carrying sheet which is fixed to the frame and an end portion of the recording material of the maximum size, carried on the carrying sheet, is 20 mm or more in a direction substantially perpendicular to the direction in which the recording material carrying means is moved.

Other objects, features and advantages of the invention will become more apparent from the following detailed description of the preferred embodiments, taken in connection with the accompanying drawings.

DETAILED DESCRIPTION OF THE PREFERRED EMBODIMENT

A first embodiment of the present invention will be described below with reference to the accompanying drawings.

Figure 16:
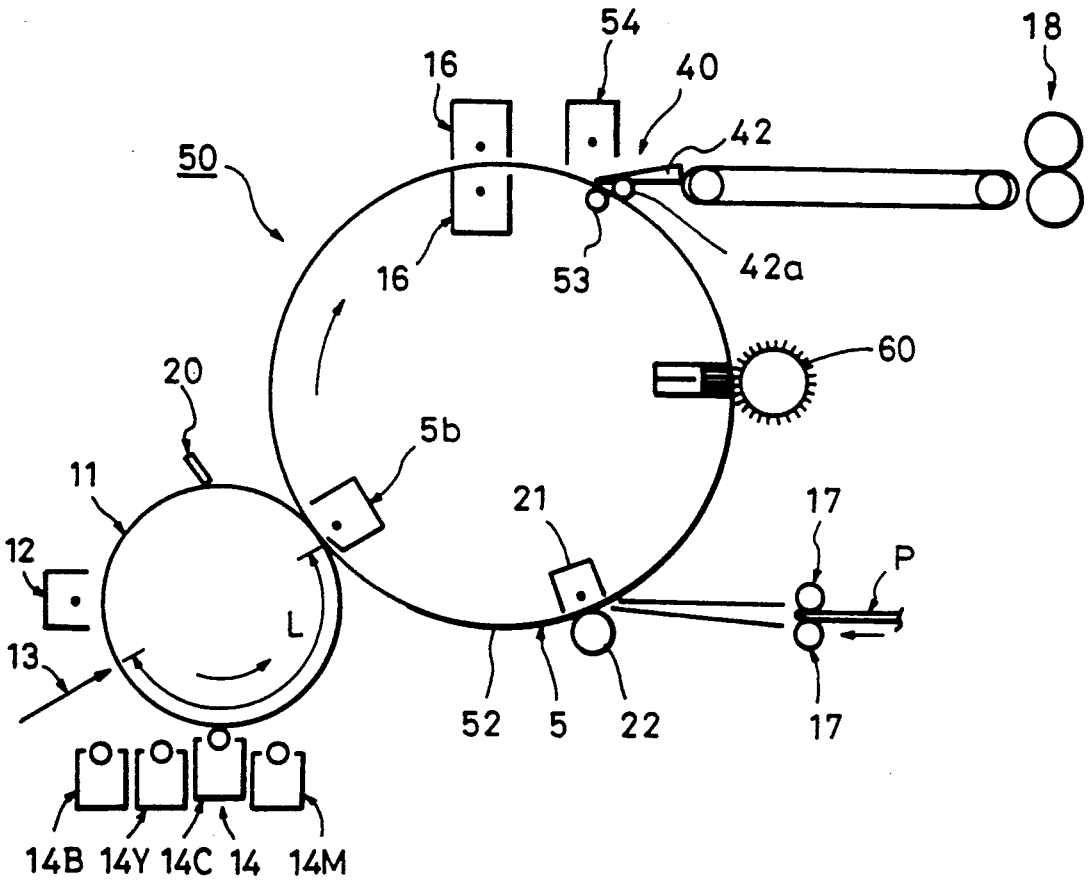
FIG. 16 is a cross-sectional view of a full-color electrophotographic apparatus which is an image forming apparatus according to the present invention.

FIG. 16 illustrates an example of a color electrophotographic apparatus to which the present invention is applied. In this example, when a rotatably supported image carrying member, i.e., a rotatably supported electrophotographic photosensitive drum 11, is rotated in a direction indicated by an arrow. It is first uniformly charged by a primary charger 12 and then exposed to a light image 13, representative of the image data, by exposure means, such as a laser beam exposure device, to form an electrostatic latent image on the photosensitive drum 11. The electrostatic latent image is made visible on the photosensitive drum 11, as a toner image, by for example a movable developing device 14. The movable developing device 14 includes four developers 14M, 14C, 14Y and 14B, which respectively house magenta developer, cyan developer, yellow developer and black developer, and a guide (not shown) which can move these four developers in a horizontal direction while retaining them. In the developing device 14, a desired developer is conveyed to a developing position which is opposite to the outer peripheral surface of the photosensitive drum 11, to develop the electrostatic latent image on the photosensitive drum.

The visible image on the photosensitive drum 11, i.e., a toner image, is transferred onto a transfer material P, which is carried and conveyed in a direction indicated by an arrow, and is then brought into contact with the photosensitive drum 11, by means of a transfer device 50, which will be described in detail later. The transfer material P is supplied to the transfer device 50 synchronously with the image formed on the photosensitive drum 11 by means of the register rollers 17.

After the toner remaining on the surface of the photosensitive drum 11 is removed by a cleaning device 20, the photosensitive drum 11 is reused for color image process.

Figure 9:
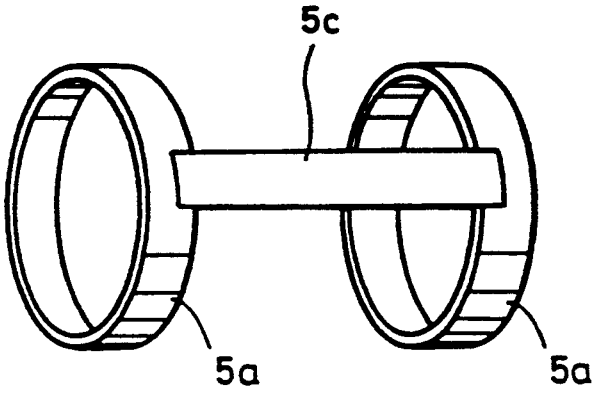
FIG. 9 PRIOR ART
FIG. 9 is a perspective view of a retaining frame.
Figure 10:
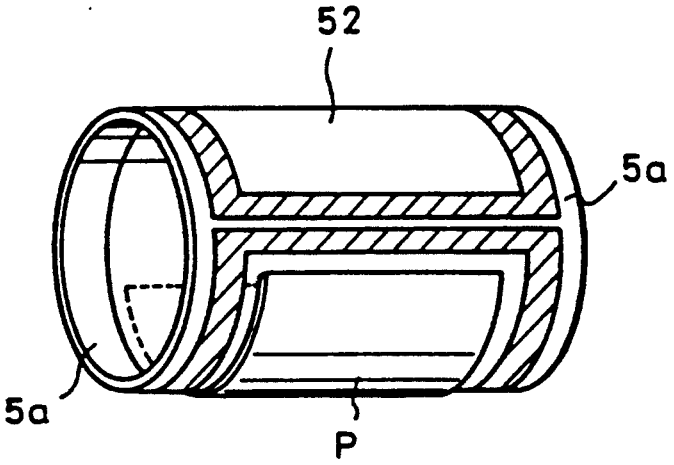
FIG. 10 PRIOR ART
FIG. 10 is a perspective view of a conventional transfer drum.
Figure 11:
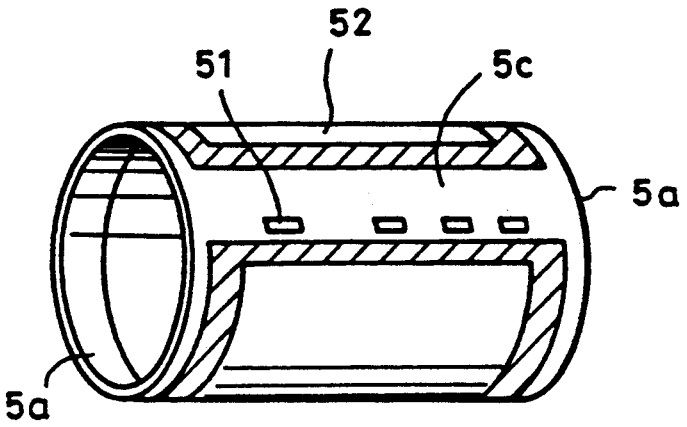
FIG. 11 is a perspective view of another example of a transfer drum with grippers.

A transfer drum 5, serving as the recording material carrying means of the transfer device 50, has basically the same structure as that shown in FIGS. 9, 10 and 11, and includes a frame having columnar ring portions 5*a*, a coupling portion 5*c*, for connecting the ring portions 5*a* with each other, and a transfer material carrying sheet 52 serving as a recording material carrying sheet, made of a dielectric film and supported by the frame in such a manner that it covers an open portion of the frame. The coupling portion 5*c* extends in a direction substantially perpendicular to the direction in which the transfer drum 5 is rotated.

The transfer drum 5 has an outer diameter of 160 mm and a circumferential length which ensures that a single sheet of transfer material P having the size of A3 or B4 can be held in the longitudinal feed direction (in a state wherein the longitudinal direction of the transfer material is substantially identical with the direction in which the surface of the transfer drum is moved) or which ensures that two sheets of transfer material P having the size of A4 or B5 can be held in a lateral feed direction (in a state wherein the longitudinal direction of the transfer material is substantially perpendicular to the direction in which the transfer drum surface is moved).

In this embodiment, the size of the transfer material used and the number of copies made may be detected by detection means so that the number of transfer materials to be attached to the transfer drum can be determined on the basis of the results of the detection.

The transfer device 50 further includes separation means 40. The separation means 40 has a plurality of separation claws 42 provided along the axis of the transfer drum 5, and outer pressing rollers 42a formed at the distal ends of the corresponding separation claws 42 integrally therewith, the purpose of which will be described later.

The transfer device 50 further includes transfer material attachment means 52 for attaching the transfer material P, supplied to the transfer device 50, to the transfer material carrying sheet 52. As shown in FIG. 16, the transfer material attachment means includes an attachment corona charger 21 provided inside the transfer drum 5, for applying to the rear surface of the transfer material carrying sheet 52 an electric charge having a polarity opposite to that of the toner image on the photosensitive drum 11, and a conductive roller 22 provided outside the transfer drum 5. The conductive roller 22 is grounded so that it can serve as an opposed electrode of the attachment corona charger 21, and inject electric charges to the transfer material P thereby allowing it to be attached to the transfer material carrying sheet 52.

Preferably, the first sheet of transfer material P is supplied to the carrying sheet 52, such that the forward end of the transfer material P is spaced from the coupling portion 5c by a predetermined distance.

If the length of the transfer material to be used in the direction of conveyance is less than half the length obtained by deducting the width of the coupling portion from the circumferential length of the transfer drum, the second sheet of transfer material is supplied successively after the first sheet of transfer material is fed, and is attached to the transfer material carrying sheet 52 at a symmetrical position with respect to the first sheet of transfer material; that is, two sheets of transfer material P are attached to the transfer material carrying sheet 52 at the same time.

The transfer material P attached to the transfer device 50 is conveyed to a transfer area where a transfer charger 5b is disposed. The transfer charger 5b applies an electric charge having a polarity opposite to that of the toner, to the rear surface of the transfer material carrying sheet 52, to transfer the developer of the first color on the photosensitive drum 11, e.g., the magenta toner, to the first transfer material P. Subsequently, the same latent image is formed again and developed by the toner of the first color, and the developed toner image is transferred to the second sheet of transfer material in a similar manner. By the time the first sheet of transfer material passes the conductive roller 22 the second time, the conductive roller 22 is retracted and moved away from the transfer material carrying sheet 52 to a position where it does not disturb the toner image transferred onto the transfer material P, e.g., to a position spaced from the transfer material carrying sheet 52 in an outward direction by 2 mm or more.

Thereafter, the toner image of the second color formed on the photosensitive drum 11, synchronously with the movement of the first sheet of transfer material P onto which the toner image of the first color has been transferred, is transferred onto the first sheet of transfer material P using the transfer corona charger 5b. Then, the toner image of the same color is transferred onto the second sheet of transfer material P on which the toner image of the first color has been transferred. Thereafter, the toner images of the remaining colors are transferred onto the two sheets of transfer material P.

In order to remove the charge on the transfer material P and transfer material carrying sheet 52 and thereby weaken the attaching force of the transfer material which has been subjected to the transfer process onto the transfer material carrying sheet, a pair of AC corona dischargers 16 are disposed in the transfer device 50 opposite each other on the two sides of the transfer material carrying sheet 52.

When the transfer material P is separated from the transfer material carrying sheet 52, an inner pressing roller 53 disposed inside the transfer drum 5 is pressed against the transfer material carrying sheet 52 from the inside thereof by means of a driving means (not shown), while the outer pressing roller 42a is pressed against the transfer material carrying sheet 52 from the outside thereof, so as to locally change the curvature of the transfer material carrying sheet and thereby deform the forward end of the transfer material. The transfer material P is separated from the transfer material carrying sheet 52 by the insertion of the separation claws 42 between the transfer material P and the transfer material carrying sheet 52.

In order to prevent image disturbance which would occur due to peel-off discharge when the transfer material P is separated from the transfer material carrying sheet 52, a corona discharger 54 for performing AC corona discharge may be provided. After separation, the transfer material carrying sheet 52 is cleaned by means of a cleaning brush 60.

If the length of the transfer material in the direction of its conveyance is larger than that mentioned above, the forward end of the transfer material P is attached to the transfer material carrying sheet 52 at the same position as that where the forward end of the aforementioned first sheet of transfer material is attached, and the transfer and separation processes are conducted on that transfer material in the same manner as that in which it is conducted on the aforementioned first sheet of transfer material.

After the transfer material P has been subjected to the transfer and separation processes, it is conveyed to a fixer 18 which applies heat to the toner to mix and fix it. Image formation ends with the discharge of the sheet of paper on which the image has been fixed. As to the transfer drum, the drum with the grippers 51, such as that shown in FIG. 11, may be used. In that case, however, only a single transfer sheet is carryed on the transfer drum.

The structure of the transfer drum which is the recording material carrying means will be further explained in detail below.

Figure 1:
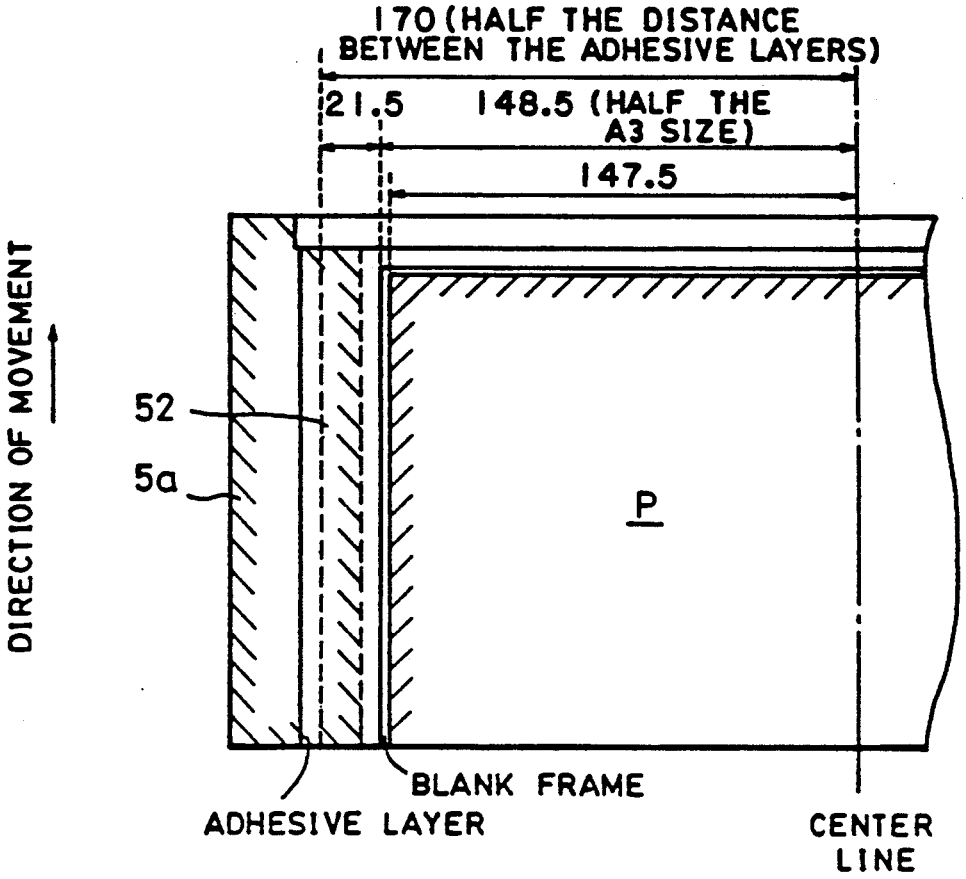
FIG. 1 is a front view illustrating how a transfer material carrying sheet is adhered to a retaining frame in a transfer device, in an image forming apparatus, according to the present invention.
Figure 2:
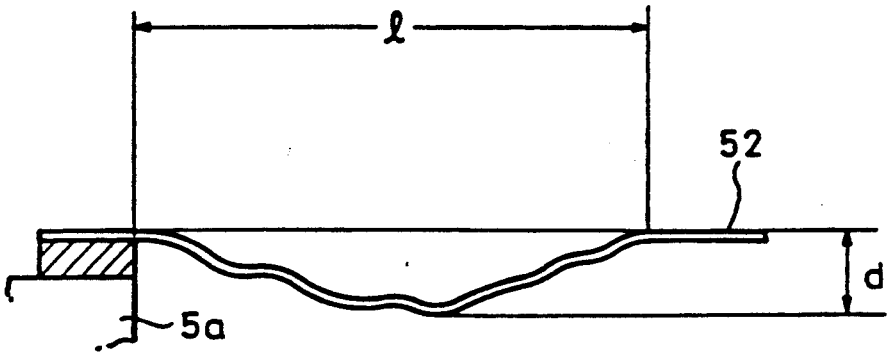
FIG. 2 is a cross-sectional view illustrating the relationship between the transfer material carrying sheet and the retaining frame.
Figure 12:
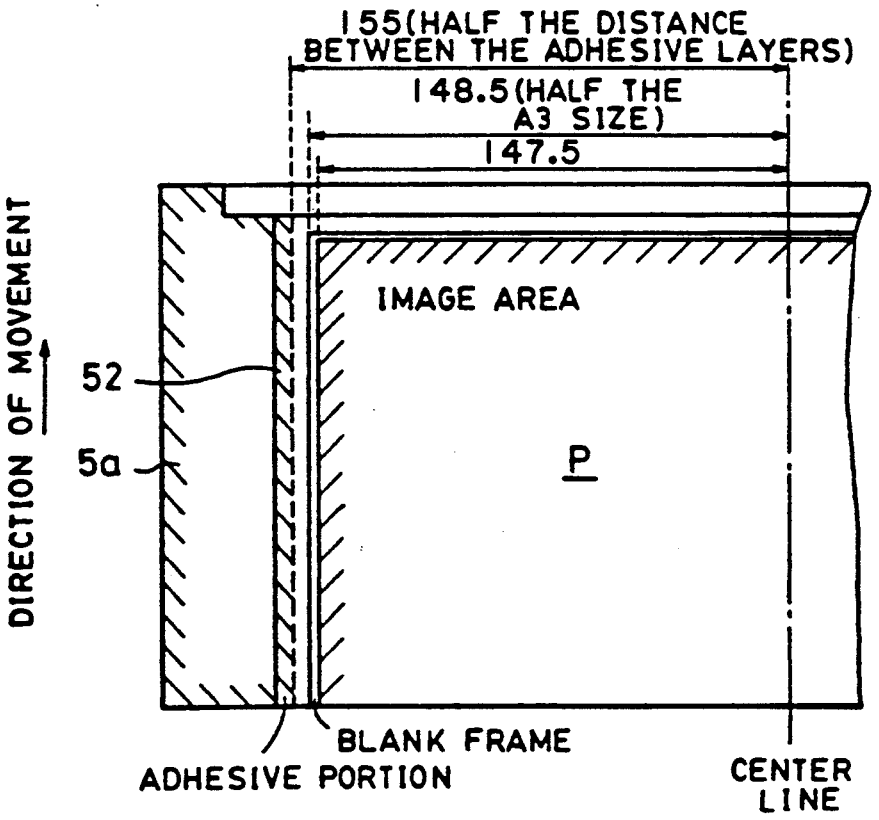
FIG. 12 PRIOR ART
FIG. 12 is a front view illustrating how a transfer material carrying sheet is adhered to a retaining frame in a conventional transfer device.
Figure 13:
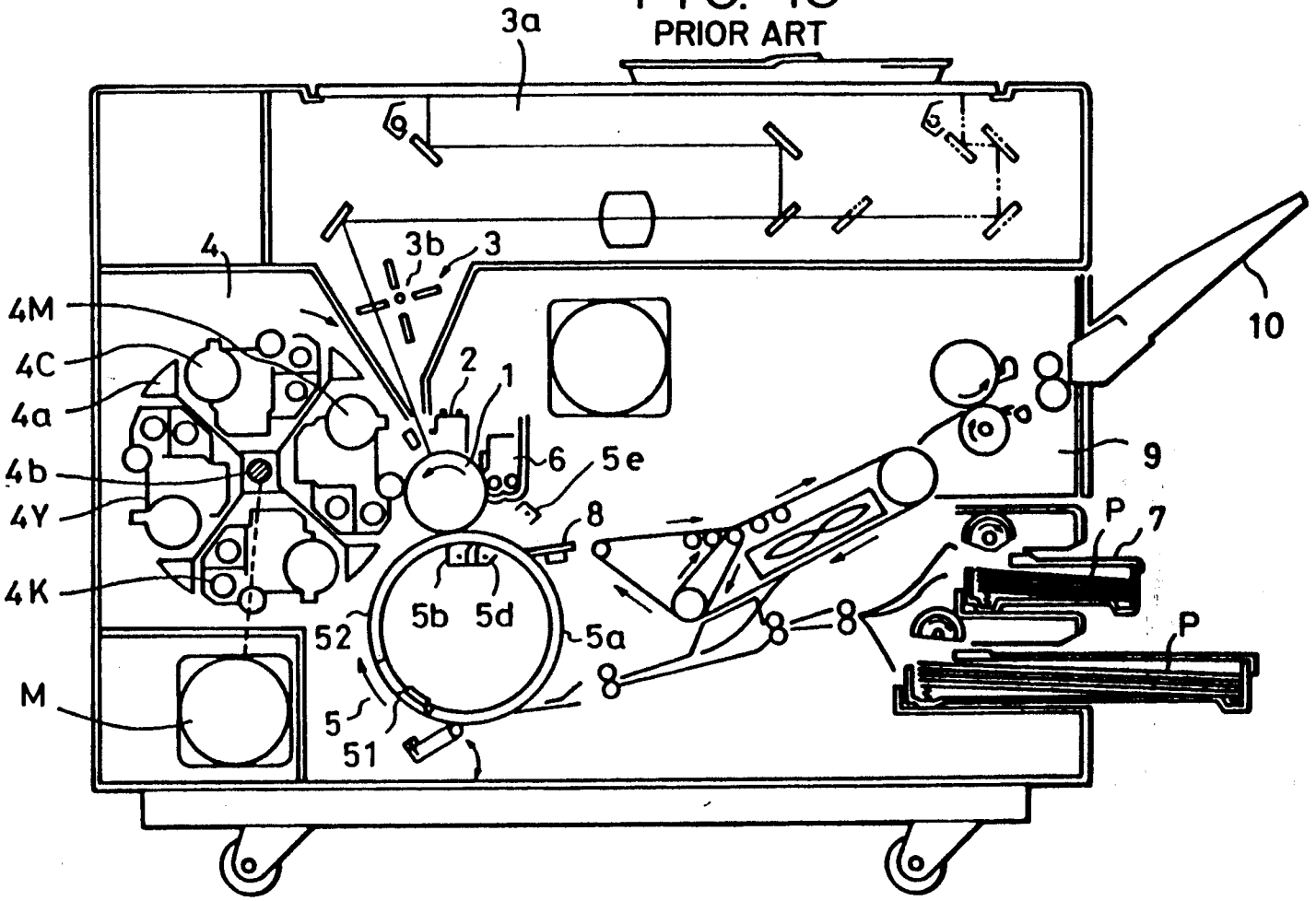
FIG. 13 PRIOR ART
FIG. 13 is a cross-sectional view of a full-color electrophotographic copying machine to which the conventional transfer device can be applied.
Figure 14:
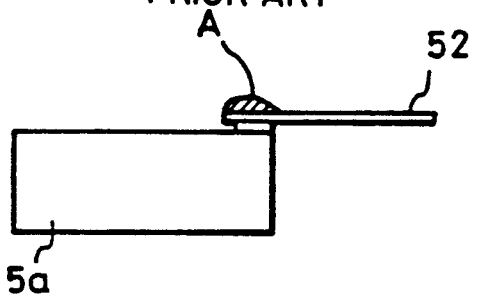
FIG. 14 (A) PRIOR ART
FIGS. 14(A) and 14(B) are cross-sectional views illustrating the relation between the transfer material carrying sheet and the ring member of the retaining frame.
Figure 14:
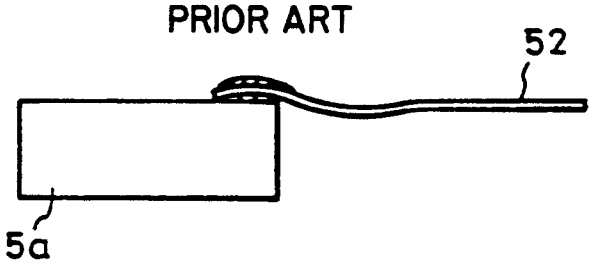
FIG. 14 (B) PRIOR ART
Figure 15:
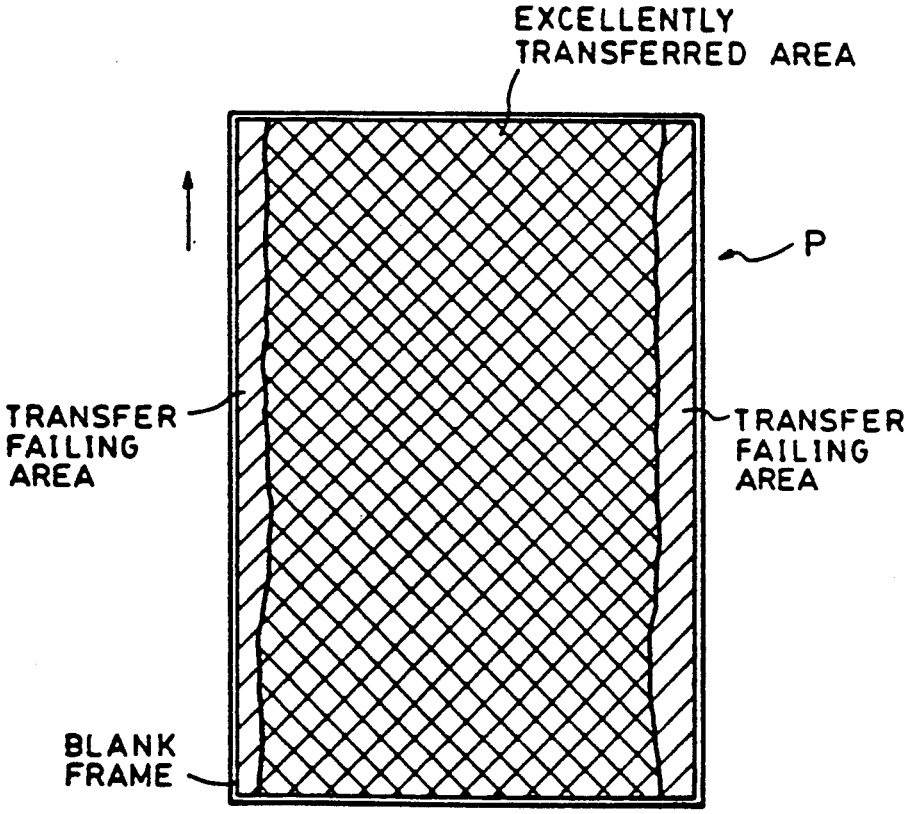
FIG. 15 PRIOR ART
FIG. 15 is a front view of a transfer material.

FIG. 12 is a view similar to FIG. 1 illustrating the dimensional relation between the transfer material carrying sheet 52 and the transfer material P in the transfer drum. The transfer drum has a size which ensures that the transfer material having the maximum size A3 can be held in a longitudinal feed state. Furthermore, the image that can be transferred onto the transfer material is set such that transfer of the image leaves a blank frame such as that shown in FIG. 1 on the sheet of transfer material. In this embodiment, as is clear from FIG. 1, the width of the transfer material carrying sheet 52 in the axial direction of the drum is wider than that of the transfer material carrying sheet of the conventional transfer drum shown in FIG. 12.

TABLE 1

| Size of transfer material | Length (mm) (Circumferential direction) | Width (mm) (Axial direction) |
|---|---|---|
| A4 | 210 | 297 |
| A3 | 420 | 297 |
| B4 | 364 | 257 |
| B5 | 257 | 182 |
| Ledger | 432 | 279 |
| Letter | 216 | 279 |

Table 1 lists the size and dimensions of the transfer materials P that can be used with the transfer drum of this embodiment. According to the present invention, as shown in FIG. 1, there is a margin of 21.5 mm at each of the two sides of the transfer material P of A4 and A3 size, having the maximum size of 297 mm in the axial direction of the drum, that is, the distance between the adhesive layer for fixing the transfer material carrying sheet 52, to the ring portion 5*a*, and the end portion of the transfer material is 21.5 mm. This margin of 21.5 mm is obtained from the results of the following experiments. It is to be noted that the transfer material P is carried on the transfer material carrying sheet 52 in such a manner that the center of the transfer material is in alignment with the center (the center line is shown in FIG. 1) of the transfer material carrying sheet 52, regardless of the size of the transfer material.

Copying was performed continuously using the aforementioned full-color electrophotographic copying machine, shown in FIG. 16, to examine the deformation of the end portion of the transfer material carrying sheet 52. The experiments were conducted under the following conditions.

1. Material of the transfer material carrying sheet 52 . . . polyvinylidene fluoride (PVdF), polyethylene terephthalate (PET), polycarbonate (PC), each of a thickness of 150 μm
2. Sampling . . . the initial copy, 500th copy, 1,000th copy, 1,500th copy, 2,000th copy, 3,000th copy, 5,000th copy, 10,000th copy, 20,000th copy, 50,000th copy (A3, four color mode)

Figure 3:
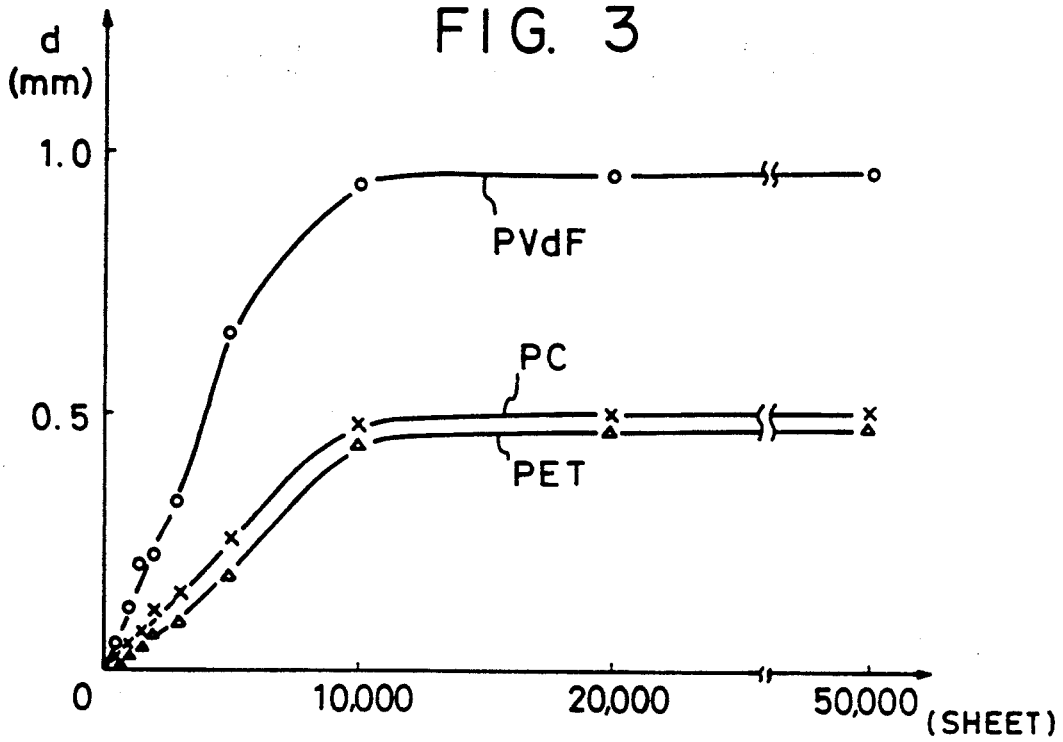
FIG. 3 is a graph showing the relation between the number of copies and the maximum deformation (d) of the transfer material carrying sheet.
Figure 4:
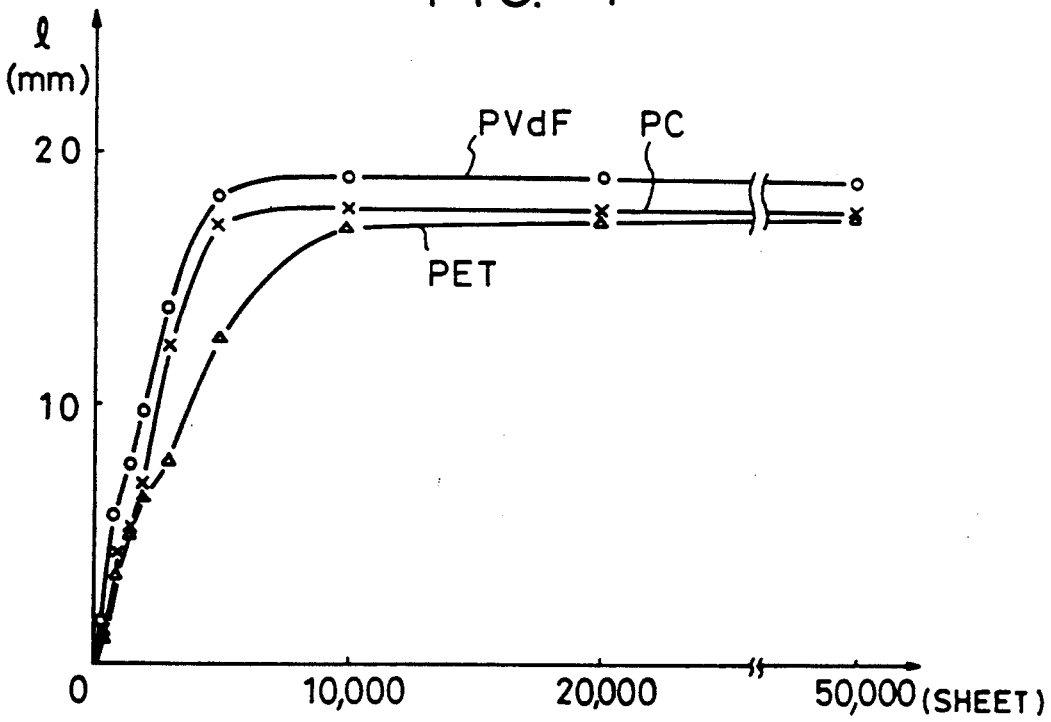
FIG. 4 is a graph showing the relation between the number of copies and the deformed area (1) of the transfer material carrying sheet.

From the experiments, the relation between the number of copies and the maximum deformation (d) of the transfer material carrying sheet 52 in the normal direction was obtained as well as the relation between the number of copies and the size of the displaced area (1) beginning from the fixed portion of the transfer material carrying sheet to the ring portion, in a direction substantially perpendicular to the direction of movement of the transfer drum. FIG. 3 shows how the maximum deformation (d) of the transfer material carrying sheet 52 varies in relation to the number of copies. FIG. 4 shows how the size of the displaced area (1) varies in relation to the number of copies.

It is clear from FIGS. 3 and 4 that (1) the maximum deformation (d) is saturated regardless of the material of the transfer material carrying sheet 52 when the number of copies reaches approximately 10,000, and (2) the size of the deformed area (1) of the transfer material carrying sheet made of PVdF is larger than that of the transfer material carrying sheets made of other two materials. However, at approximately 10,000 copies, the size of the deformed area is substantially the same regardless of the material of the transfer material carrying sheet 52.

It can be seen from the results of the aforementioned experiments that the deformed area of the transfer material carrying sheet 52 is substantially the same regardless of the material of the transfer material carrying sheet 52, and that the size of deformed area ranges from 16 mm to 20 mm.

Therefore, it is desired that the distance between the two portions of the transfer material carrying sheet fixed to the corresponding ring portions by means of the adhesive layers and the two end portions of the transfer material carried on the transfer material carrying sheet be 20 mm or above.

Figure 5:
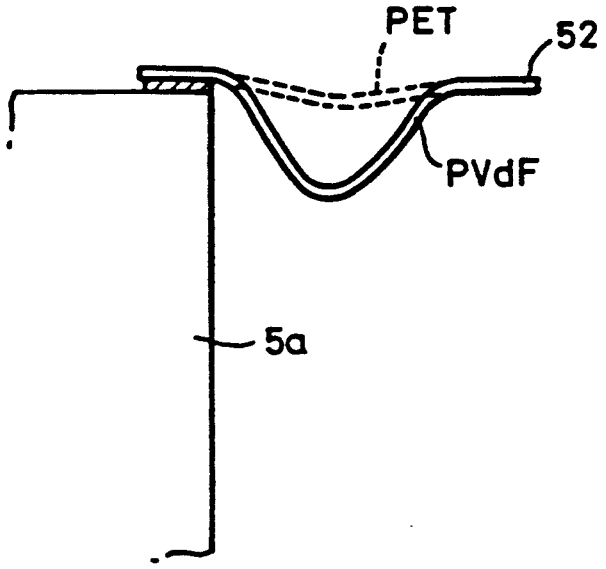
FIG. 5 is a cross-sectional view illustrating that the amount of deformation differs depending on the material of a transfer material carrying sheet.

The maximum deformation (d) of PVdF is larger than that of the other two types of materials while the deformed area (1) of PVdF is almost the same as that of the other two types of material, because PC and PET are stiffer than PvdF and are therefore deformed over a wider area when the same amount of deformation occurs, while PVdF is relatively soft and thus readily follows the shape of the photosensitive drum depending on the stiffness of the paper attached thereto, thus restricting the deformed area even when a large amount of deformation (d) occurs thereto, as shown in FIG. 5.

Figure 6:
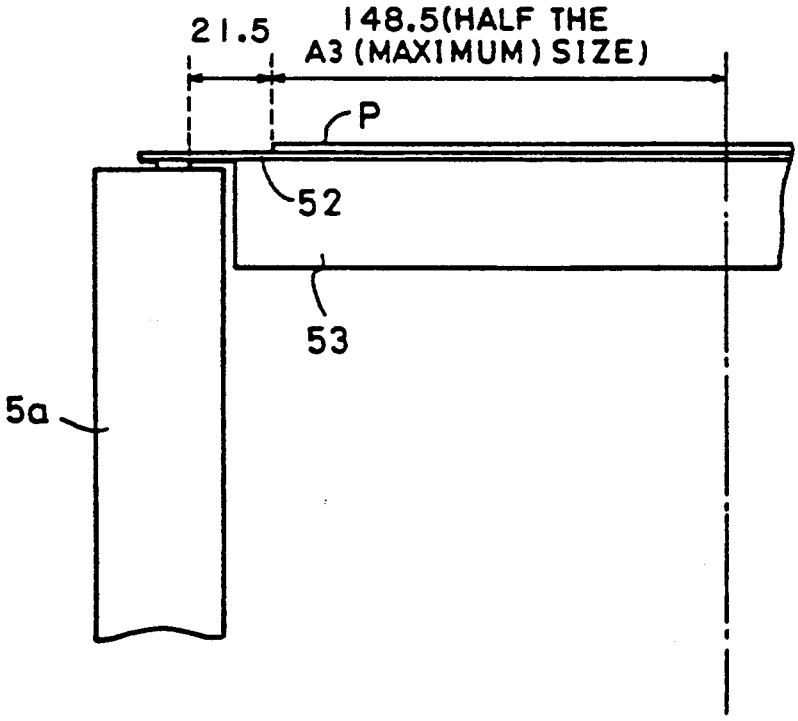
FIG. 6 is a cross-sectional view illustrating the relation between a transfer material carrying sheet, a pressing member and a retaining frame.
Figure 7:
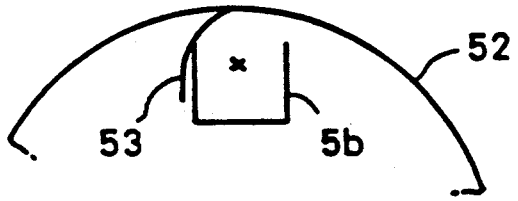
FIG. 7 is a schematic cross-sectional view of another embodiment of a transfer drum provided with a pressing member.

FIGS. 6 and 7 show a second embodiment of the transfer drum. In this transfer device, the transfer charger 5*b* is disposed in the transfer portion of the transfer drum which makes contact with the photosensitive drum 11, and a pressing member 53, for pressing the transfer material carrying sheet 52 against the photosensitive drum 1, is mounted on an upstream side shielding plate of the transfer charger 5*b* with respect to the rotational direction of the transfer drum 5. The pressing member 53 is a sheet made of polyethylene teraphthalate. In this embodiment, the transfer material carrying sheet 52 can be kept smooth.

Figure 8:
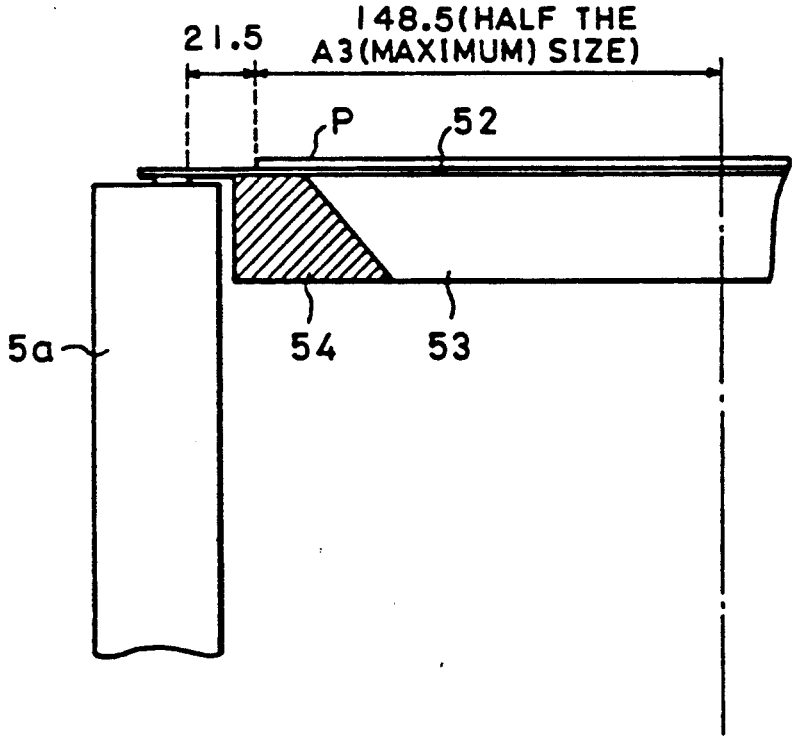
FIG. 8 is a cross-sectional view illustrating the relation between a transfer material carrying sheet, a pressing member, a superimposed sheet and a retaining frame.

FIG. 8 shows a third embodiment of the transfer drum. In this embodiment, a similar pressing member to that employed in the second embodiment is provided. However, a sheet 54 made of the same material as the pressing member 53 is pasted only on the two end portions of the pressing member 53, to increase the thickness of the end portions. In this way, the pressing force of the end portions of the transfer material carrying sheet 52 against the photosensitive drum 11 can be increased, and the transfer material carrying sheet 52 will be kept smooth. As shown in FIG. 8, the position of the end portion where the sheet 54 is provided, overlaps the transfer material carrying area of the transfer material carrying sheet on which the transfer material P having the maximum size can be carried.

The thickness of the sheet 53 employed in the second and third embodiments is approximately 125 μm, and the thickness of the sheet 54 to be pasted on the end portion of the sheet 53 is approximately 100 μm.

As will be understood from the foregoing description, in the transfer device according to the present invention, the portion of the transfer material carrying sheet which is fixed to the retaining frame is located at a position sufficiently spaced from the edge of the transfer material having the maximum size (by 20 mm or more). Consequently, even when the transfer device is used for a long time, excellent transfer which is free from transfer failure can be performed, and images of high quality can thus be obtained.

While the preferred embodiments have been described, many variations thereof will now be apparent to those skilled in the art within the scope of the present inventive concepts which are delineated by the following claims.

What is claimed is:

1. An image forming apparatus comprising:

image forming means for forming images on a recording material at an image forming position; and movable recording material carrying means for carrying and conveying the recording material to the image forming position, said recording material carrying means including a carrying sheet for carrying the recording material, and a frame which supports an end portion of said carrying sheet in a second direction which is substantially perpendicular to a first direction in which said carrying means is moved, wherein a distance between a portion of said carrying sheet which is fixed to said frame and an end portion of the recording material of a maximum size carried on said carrying sheet is 20 mm or more in the second direction.

2. The image forming apparatus according to claim 1, wherein said recording material carrying means has an adhesive layer adhering said carrying sheet to said frame at the portion of said carrying sheet which is fixed to said frame.

3. The image forming apparatus according to claim 1, wherein said frame has first and second ring portions, a coupling portion for coupling said two ring portions with each other, and an open portion formed by said ring portions wherein said open portion is covered by said carrying sheet.

4. The image forming apparatus according to claim 1, wherein said image forming means includes an image carrying member, means for forming a toner image on said image carrying member, and transfer means for transferring the toner image on said image carrying member onto the recording material carried on said carrying sheet.

5. The image forming apparatus according to claim 4, wherein a plurality of toner images are transferred to the recording material carried on said carrying sheet on top of one another.

6. The image forming apparatus according to claim 5, wherein said apparatus is capable of forming a full-color image on the recording material.

7. The image forming apparatus according to claim 4, further comprising attachment means for electrostatically attaching the recording material to said carrying sheet.

8. The image forming apparatus according to claim 4, further comprising a pressing member for pressing the recording material carried on said carrying sheet against said image carrying member.

9. The image forming apparatus according to claim 8, wherein said pressing member has a sheet-like form and is provided in the second direction, a thickness of an end portion of said pressing member being larger than that of a central portion thereof in the second direction.

10. The image forming apparatus according to claim 9, wherein the end portion of said pressing member overlaps a carrying area of said carrying sheet on which the recording material having the maximum size is carried.

11. The image forming apparatus according to claim 8, wherein said pressing member is provided in the second direction, a pressing force of an end portion of said pressing member being larger than that of a central portion thereof in the second direction.

12. The image forming apparatus according to claim 11, wherein the end portion of said pressing member overlaps a carrying area of said carrying sheet on which the recording material having the maximum size is carried.

13. An image forming apparatus according to claim 1, wherein said distance is larger than a distance between said frame and the end portion of the recording material of the maximum size carried on said carrying sheet.

* * * * *

UNITED STATES PATENT AND TRADEMARK OFFICE

CERTIFICATE OF CORRECTION

PATENT NO. : 5,249,021

DATED : September 28, 1993

INVENTOR(S) : TAKASHI HASEGAWA, ET AL.

It is certified that error appears in the above-identified patent and that said Letters Patent is hereby corrected as shown below:

COLUMN 1

Line 15, "Art {In" should read --Art ¶ In--.
Line 54, "gitudinaI" should read --gitudinal--.
Line 63, "fullcolor" should read --full-color--.

COLUMN 4

Line 20, "arrow. It" should read --arrow, it--.
Line 27, "14. The" should read --14. ¶ The--.

COLUMN 8

Line 1, "other" should read --the other--.
Line 21, "PvdF" should read --PVdF--.
Line 38, "teraphtha-" should read --terephtha- --.
Line 50, "creased, and" should read --creased as compared to a center portion of the pressing member, and--.

Signed and Sealed this

Seventeenth Day of May, 1994

Bruce Lehman

BRUCE LEHMAN

*Commissioner of Patents and Trademarks*

*Attest:*

*Attesting Officer*

--